US009802235B2

(12) United States Patent
Friesen et al.

(10) Patent No.: US 9,802,235 B2
(45) Date of Patent: Oct. 31, 2017

(54) METHOD FOR PRODUCING A TORSIONAL PROFILE FROM A BLANK, AND TORSIONAL PROFILE

(71) Applicant: BENTELER AUTOMOBILTECHNIK GMBH, Paderborn (DE)

(72) Inventors: Dieter Friesen, Paderborn (DE); Paul Kaupmann, Anroechte (DE); Jan Krull, Schlangen (DE); Norbert Niggemeyer, Paderborn (DE); Eugen Seibel, Paderborn (DE)

(73) Assignee: BENTELER AUTOMOBILTECHNIK GMBH, Paderborn (DE)

( * ) Notice: Subject to any disclaimer, the term of this patent is extended or adjusted under 35 U.S.C. 154(b) by 238 days.

(21) Appl. No.: 14/794,627

(22) Filed: Jul. 8, 2015

(65) Prior Publication Data

US 2016/0008863 A1 Jan. 14, 2016

(30) Foreign Application Priority Data

Jul. 10, 2014 (DE) ..... 10 2014 109 680

(51) Int. Cl.
*B21D 7/00* (2006.01)
*B21D 22/02* (2006.01)
*B21D 53/88* (2006.01)

(52) U.S. Cl.
CPC ..... *B21D 7/00* (2013.01); *B21D 22/025* (2013.01); *B21D 53/88* (2013.01)

(58) Field of Classification Search
CPC ..... B21D 7/00; B21D 53/88; B21D 22/025
USPC ..... 280/124.167; 29/897.2
See application file for complete search history.

(56) References Cited

U.S. PATENT DOCUMENTS

| | | | | | |
|---|---|---|---|---|---|
| 4,217,970 | A * | 8/1980 | Chika | B60G 21/055 | 180/298 |
| 4,739,918 | A | 4/1988 | Stokes et al. | | |
| 4,750,757 | A * | 6/1988 | Long | B60G 11/60 | 248/74.2 |
| 4,951,962 | A * | 8/1990 | Tomida | B60G 21/051 | 280/124.108 |
| 6,145,271 | A * | 11/2000 | Kossmeier | B60G 21/051 | 296/146.6 |
| 6,523,841 | B2 | 2/2003 | Glaser et al. | | |
| 6,616,157 | B2 | 9/2003 | Christophliemke et al. | | |

(Continued)

FOREIGN PATENT DOCUMENTS

| | | | | |
|---|---|---|---|---|
| DE | 196 53 959 | C1 | 2/1998 | |
| DE | 101 02 759 | A1 | 7/2002 | |
| DE | 10 2007 002 448 | A1 | 7/2008 | |
| DE | 10 2007 002 449 | B4 | 7/2008 | |
| DE | 10 2008 052 554 | A1 | 4/2010 | |
| DE | 10 2009 031 981 | A1 | 8/2010 | |
| EP | 0 752 332 | B1 | 1/1997 | |
| EP | 1 036 678 | A2 | 9/2009 | |
| EP | 1036678 | | 9/2009 | |
| JP | 2001-146110 | | 5/2001 | |
| JP | 2001-146110 | A | 5/2001 | |
| JP | 2005-162080 | | 6/2005 | |
| JP | 2005-162080 | A | 6/2005 | |
| JP | 2010194611 | A * | 9/2010 | B21D 22/025 |

OTHER PUBLICATIONS

U.S. Appl. No. 14/790,713, filed Jul. 2, 2015, Claussen et al.

*Primary Examiner* — Darlene P Condra
(74) *Attorney, Agent, or Firm* — Sheridan Ross P.C.

(57) ABSTRACT

The invention relates to a method for producing a torsional profile from a blank. The torsional profile has torsionally rigid tubular end sections, a torsionally flexible U-shaped middle longitudinal section and, between the middle longitudinal section and the end sections, transition sections which change from the U-shaped cross section to the tubular cross section.

10 Claims, 5 Drawing Sheets

(56) References Cited

U.S. PATENT DOCUMENTS

| | | | | |
|---|---|---|---|---|
| 6,758,921 | B1 * | 7/2004 | Streubel | B21D 53/88 148/519 |
| 8,091,201 | B2 † | 1/2012 | Johnson | |
| 8,894,080 | B2 * | 11/2014 | Fukushi | B21D 53/88 267/273 |
| 2002/0005622 | A1 | 1/2002 | Glauser et al. | |
| 2002/0105159 | A1 * | 8/2002 | Christophliemke | B60G 7/001 280/124.166 |
| 2003/0044632 | A1 * | 3/2003 | Schonleber | B62D 27/026 428/595 |
| 2007/0052194 | A1 | 3/2007 | Marchel | |
| 2007/0075518 | A1 | 4/2007 | Murata | |
| 2009/0020974 | A1 * | 1/2009 | Lee | B60G 21/051 280/124.107 |
| 2011/0212339 | A1 * | 9/2011 | Binder | B22F 7/08 428/546 |
| 2015/0104717 | A1 * | 4/2015 | Kim | H01M 4/13 429/338 |
| 2015/0151352 | A1 * | 6/2015 | Peters | B21D 53/88 29/897.2 |

* cited by examiner
† cited by third party

METHOD FOR PRODUCING A TORSIONAL PROFILE FROM A BLANK, AND TORSIONAL PROFILE

CROSS-REFERENCE TO RELATED APPLICATIONS

This application claims the benefit of German Patent Application No. DE 10 2014 109 680.0, filed Jul. 10, 2014, the entire content of which is incorporated herein by reference.

FIELD

The invention relates to a method for producing a torsional profile from a blank, and to a torsional profile.

BACKGROUND

DE 10 2009 031 981 A1, which can be attributed to the applicant, has disclosed both a method of said type and a torsional profile of said type. In the method in said document, to produce the torsional profile, a blank has a longitudinally directed U-shaped depression provided therein at a distance from its face ends. The legs of the thus deformed blank, which legs are formed adjacent to the depression, are subsequently bent so as to be substantially parallel to one another and to the central longitudinal axis of the depression. The bent legs are deformed into a tubular shape in the regions adjacent to the face ends of the blank, such that the longitudinal edges of said legs are in contact, and said bent legs are, in the longitudinal section with the depression, deformed into an O-shape in a manner adapted to the contour of the depression. Finally, the longitudinal edges of the deformed legs are welded to one another, such that the then finished torsional profile is produced for further use.

However, in the case of the torsional profile produced in accordance with the method known from DE 10 2009 031 981 A1, the bent legs of the blank bear directly against the delimiting walls of the depression formed into the blank, such that said legs are in direct contact with one another. Torsional profiles produced in this way duly have adequate torsional strength, in particular for automotive applications, such as is required in particular in safety-relevant areas in the automotive sector for such torsional profiles. However, such torsional profiles have inherent in them the undesired characteristic that, under torsional load, under some circumstances, undesired noise is generated since the bent legs of the blank and the delimiting walls of the depression formed into the blank in the middle longitudinal section, which can be subjected to torsional load, rub against one another. Said noises may in this case lie in a frequency range which is unpleasant or even harmful to human hearing, such that torsional profiles of said type are not suitable for comfortable operation of a motor vehicle.

SUMMARY

Embodiments of the present disclosure provide a method for producing a torsional profile from a blank, and to provide a torsional profile in the case of which undesired generation of noise does not occur.

The method according to the invention for producing a torsional profile from a blank, which torsional profile has torsionally rigid tubular end sections, a torsionally flexible U-shaped middle longitudinal section and, between the middle longitudinal section and the end sections, transition sections which change from the U-shaped cross section to the tubular cross section, has the following method steps:

a) forming a longitudinally oriented U-shaped depression into the blank at a distance from the face ends thereof, so as to form legs which extend away from the depression,
b) bending the legs of the deformed blank adjacent to the depression such that said legs are arranged substantially parallel to one another and to the middle longitudinal plane of the depression,
c) deforming the bent legs into a tubular shape in the regions adjacent to the face ends of the blank, and deforming the bent legs into a U-shape in the longitudinal section with the depression, in a manner adapted to the contour of the depression, longitudinal edges of the bent legs being arranged facing one another over their entire longitudinal extent.

The method according to the invention is now characterized by the following further method steps:

d) introducing at least one spacer into the deformed blank such that the bent legs and delimiting walls, which extend in the direction of longitudinal edges of the middle longitudinal section, of the depression are held spaced apart at least in regions, and
e) joining the longitudinal edges of the deformed legs.

In this case, the individual method steps do not need to be performed chronologically in the sequence presented here; in particular, it is also possible for method step d) to be performed before any of method steps a), b) or c).

The blank may have any possible contour. However, the blank is advantageously of rectangular contour, such that when the legs of the deformed blank are bent after a longitudinally directed U-shaped depression has been formed in said blank at a distance from the face ends thereof, have approximately the same width over their entire longitudinal extent. Here, the bent legs are bent so as to be arranged substantially parallel to one another and parallel to the central longitudinal plane of the depression. As a result of the bent legs being deformed into tubular form in the regions adjacent to the face ends and the bent legs being deformed into a U-shape in the longitudinal section with the depression, in a manner adapted to the contour of the depression, the longitudinal edges of the bent legs are arranged facing one another over their entire longitudinal extent. Here, the deformation into a tubular shape is not intended to entail a restriction to a circular, oval or similar geometry. Rather, this should be understood to mean any deformation, such that the end sections of the profile thus formed may be shaped to fit onto other components, wherein said end sections are self-evidently of correspondingly torsionally rigid form.

Embodiments of the invention are characterized in that, through the introduction of at least one spacer into the deformed blank, the bent legs and delimiting walls, which extend in the direction of longitudinal edges of the middle longitudinal section, of the depression are held spaced apart at least in regions, wherein, after the joining of the longitudinal edges of the deformed legs, the bent legs and the delimiting walls of the depression in the middle longitudinal section, which can be subjected to torsional loading in the torsional profile, are spaced apart. In this way, it is achieved according to the invention that the bent legs and the delimiting walls no longer rub or slide against one another over the full area under torsional load, such that the generation of noises, in particular in frequency ranges that are unpleasant or even harmful to human hearing, is effectively reduced. It is however particularly advantageous if the bent legs and the delimiting walls, which extend in the direction of longitudinal edges of the middle longitudinal section, of the depression are held spaced apart over their entire longitudinal extent. It is achieved in this way that the bent legs and the delimiting walls no longer rub or slide against one another at all under torsional load, such that the generation of noises, in particular in frequency ranges that are unpleasant or even harmful to human hearing, is effectively reduced.

Since, owing to the fact that the blank is normally composed of a metal, in particular a steel or aluminum, the joining of the longitudinal edges is performed by way of a welding process, and thus with the input of a large amount of energy, it is provided in a first refinement of the method according to the invention that a protruding bulge is formed out of the base of the depression in the direction of the longitudinal edges of the middle longitudinal section. This reliably prevents a situation in which the energy input during the joining or welding process causes the base of the depression to also be welded to the bent legs. In this way, a free space is formed between the bent legs and the bulge in the region of the base of the depression, which free space prevents the possibility of the legs being welded to the base of the depression.

In a first particularly advantageous refinement of the method according to the invention, the introduction of the at least one spacer is performed between the longitudinal edges of the bent legs. It is achieved in this way that the entire production method from the already known DE 10 2009 031 981 A1 can continue to be used, wherein it is merely the case that the subsequent joining can be performed only after said spacer has been introduced. Although it is then the case that the bent legs still bear against the delimiting walls of the depression before the introduction of the spacer, the introduction of the spacer between the longitudinal edges of the bent legs has the effect that the bent legs are bent apart slightly, such that the required spacing is formed between these and the delimiting walls of the depression. The gap that is thus produced between the bent legs and the delimiting walls is sufficient to prevent generation of noise under torsional load of the middle longitudinal section of the torsional profile.

The spacer which is thus introduced into the gap between the longitudinal edges of the deformed legs is then joined, in particular welded, to the deformed legs in the region of their longitudinal edges, giving rise to the finished torsional profile.

In a further method according to the invention, however, the introduction of the at least one spacer is performed such that, after the deformation of the bent leg into a U-shape, said at least one spacer is situated between the bent leg and a delimiting wall, which extends in the direction of the longitudinal edges of the middle longitudinal section, of the depression. In this case, use is advantageously made of two spacers, such that in each case one is situated between a bent leg and a delimiting wall on each side of the depression. The introduction of a spacer of said type also serves to prevent full contact between the bent legs and the delimiting walls of the depression in the middle longitudinal section of the torsional profile, such that in this way, too, the generation of noise as a result of rubbing of the legs against the delimiting walls under torsional load is prevented.

In order that generation of noise does not occur, solid lubricants, for example graphite, graphene, molybdenum sulfide, polytetrafluoroethylene or similar solid lubricants, are advantageously used as spacers. The friction or sliding characteristics of said materials enable said elements to slide virtually silently, in a manner not perceptible to human hearing, on the delimiting walls of the depression or on the bent legs. Here, said spacers may be arranged at the corresponding locations of the blank already before the blank is deformed. It is however also conceivable for said spacers to be positioned at the corresponding positions on the already deformed blank during one of the various production steps. Furthermore, it may also be provided here that the spacers are produced in the form of a deformed portion of the bent leg or of the delimiting walls of the depression, and are provided with a corresponding solid lubricant in the region of the surface which extends to the delimiting walls or to the bent legs. It is self-evidently also possible here for use to be made not of solid lubricants but of viscous lubricants. If appropriate, it may also be provided that both the solid lubricants and the viscous lubricants are, after the production of the torsional profile, released from the torsional profile again, for example by chemical means or else by being broken up under torsional load, wherein the spacing of the legs to the delimiting walls of the depression is however maintained.

In the case of a torsional profile produced in accordance with a method of said type, it is the case, as is already known from the prior art, that the longitudinal edges of the deformed legs are joined, in particular welded, to one another.

The torsional profile according to the invention which is produced from a blank has a torsionally rigid, tubular end section, a torsionally flexible, U-shaped middle longitudinal section which forms a depression, and, between the middle longitudinal section and the end sections, transition sections which change from the U-shaped cross section to the tubular cross section, wherein the middle longitudinal section is formed such that bent legs and delimiting walls, which extend in the direction of the longitudinal edges of the middle longitudinal section, of the depression are arranged adjacent to one another. The torsional profile according to the invention is now characterized in that at least one spacer is provided, by means of which the bent legs are held with a spacing around the delimiting walls of the depression in the middle longitudinal section.

By means of this refinement of the torsional profile according to the invention, it is achieved that a gap is formed between the delimiting walls of the depression and the bent legs of the profile, such that under torsional load, said delimiting walls and legs do not come into direct contact with one another, such that generation of noise is prevented in an effective manner.

In a first advantageous refinement of the torsional profile according to the invention, the at least one spacer is arranged between longitudinal edges of the deformed legs. It is achieved in this way that a spacer of said type can be easily introduced into a gap between the longitudinal edges of the deformed legs, whereby the bent legs are pushed apart slightly again, such that the gap between the legs and the delimiting walls of the depression is formed. By varying the spacer, it is possible here to realize torsional profiles with different spacings between the legs and the delimiting walls, wherein it is however possible to utilize the same production tools. This is advantageous in particular because, in this way, there is no need to stock a multiplicity of production tools in order to produce different torsional profiles with different torsional characteristics. In this way, the torsional characteristics of the torsional profile can be set through corresponding use of the spacer.

In this case, the spacer is joined, in particular welded, to the longitudinal edges of the deformed legs.

In another refinement of the invention, it has proven to be advantageous for at least one spacer to be arranged between the bent legs and a delimiting wall, which extends in the direction of the longitudinal edges of the middle longitudinal section, of the depression. In this way, too, the bent legs and the delimiting walls of the depression are held spaced apart, such that in this case too, a gap between said elements is formed, such that under torsional load in the middle longitudinal section, no contact occurs between the legs and the delimiting walls of the depression. In the case of such an embodiment, the longitudinal edges of the deformed legs are again joined, in particular welded, to one another.

In order that no noise generation occurs as a result of possible friction between the spacer and the delimiting walls of the depression or the bent legs, it has proven to be particularly advantageous if the at least one spacer is composed of a solid lubricant, in particular of graphite, graphene, molybdenum sulfide, polytetrafluoroethylene or the like. Such solid lubricants specifically have the particular characteristic that they slide particularly easily on other materials, in particular relatively smooth materials, without generation of noise.

The spacing between the bent legs and the delimiting walls of the depression is advantageously uniform over the entire middle longitudinal section. Specifically, such torsional profiles can be produced particularly inexpensively. It is however also possible for a torsional profile according to the invention to be designed such that the spacing between the bent legs and the delimiting walls of the depression varies over the middle longitudinal section.

As has already been discussed with regard to the method according to the invention, it has proven to be advantageous if, in the region of the joints, the depression has a protruding bulge which extends out of the base so as to form a free space in the direction of the longitudinal edges of the middle longitudinal section. This is effective in preventing the delimiting walls of the depression and the bent legs inadvertently being joined or welded to one another when a large amount of energy is input into the material during the welding process.

The torsional profile according to the invention is advantageously produced in accordance with the method according to the invention as described above.

Further aims, advantages, features and possible uses of the present invention will emerge from the following description of exemplary embodiments on the basis of the drawings. In this case, all of the features described and/or illustrated in the figures form the subject matter of the present invention individually or in any desired meaningful combination, even independently of their combination in the claims or their back-references.

DETAILED DESCRIPTION

Figure 1:
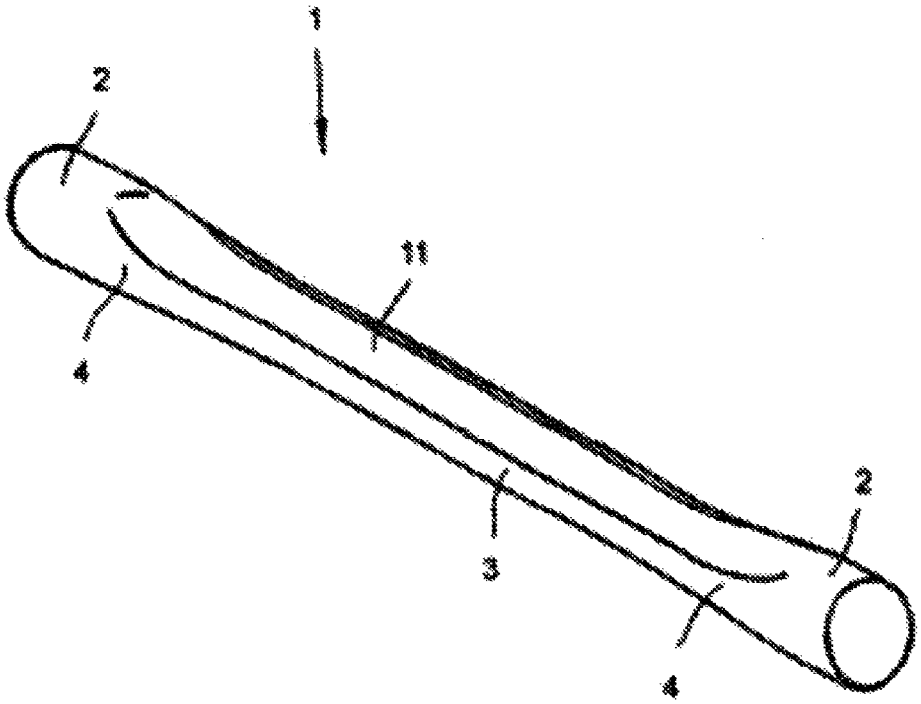
FIG. 1 shows an exemplary embodiment of a torsional profile according to the invention in a perspective illustration.

FIG. 1 shows an exemplary embodiment of a torsional profile 1 according to the invention in a perspective illustration. The torsional profile 1 in this case has torsionally rigid, substantially circular, tubular end sections 2, a torsionally flexible, U-shaped middle longitudinal section 3, and, between the middle longitudinal section 3 and the end sections 2, transition sections 4 which change from the U-shaped cross section to the tubular cross section. In this case, the torsional profile 1 is equipped, in the middle longitudinal section 3, with a depression 11, such that owing to said depression 11, the middle longitudinal section 3 is of U-shaped form. A base 47 of said depression is in this case arranged opposite longitudinal edges 7 which are of ear-like form, wherein the torsional profile 1 is thus of double-layered or double-walled form in the middle longitudinal section 3.

Figure 2:
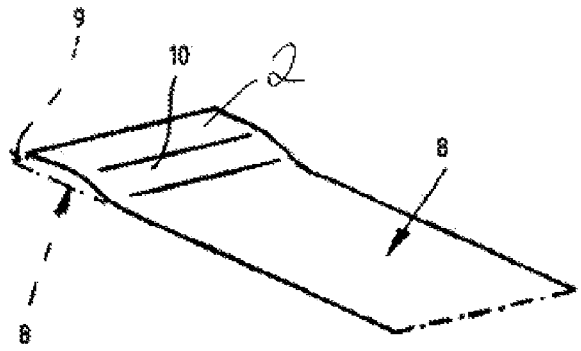
FIGS. 2 to 5 show various method steps during the production of an exemplary embodiment of a torsional profile according to the invention, in perspective illustrations.

The torsional profile 1 is produced from a rectangular metal blank 8, one half of which is illustrated in FIG. 2. The other half is of mirror-symmetrical design, such that below, in FIGS. 3 to 5, only said one half will be illustrated and described.

For the manufacture of the torsional profile, those regions 10 of the blank 8 which are adjacent to the face ends 9 are firstly deformed into an S-shape. The tools used for this purpose are not illustrated in any more detail.

Subsequently, the thus deformed blank 8 is equipped, between the S-shaped regions 10, with a U-shaped depression 11. To produce the depression 11, the blank 8 is placed between an upper tool (not illustrated here) and a lower tool (likewise not illustrated here). The upper tool defines, by way of a bulge, the inner contour of the depression, whereas the lower tool, with a channel, serves as a counterbearing and defines the outer contour.

Figure 3:
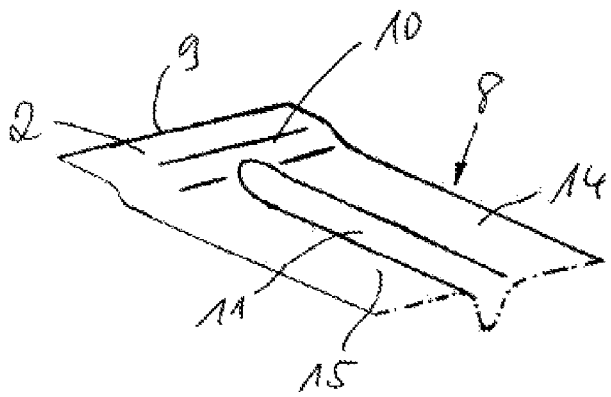

The depression 11 is formed centrally into the blank 8 such that legs 14 and 15 of approximately equal width are formed adjacent to the depression 11. A blank 8 thus deformed is illustrated in FIG. 3. In a subsequent working step, by means of a further upper tool (not illustrated here) and a lower tool (likewise not illustrated here), the legs 14 and 15 of the blank 8, which remain approximately identical, are bent adjacent to the depression 11 so as to be substantially parallel to one another and to the central longitudinal plane of the depression 11. A correspondingly deformed blank 8 is illustrated in FIG. 4.

Figure 4:
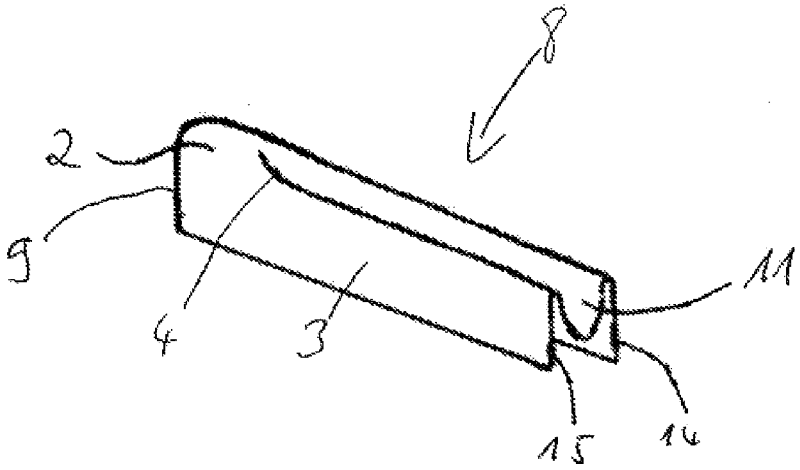

The blank 8 that has been deformed as in FIG. 4 is subsequently reconfigured, using further tools, such that the legs 14 and 15 are deformed into a tubular shape in the ends of the deformed blank 8, such that their longitudinal edges 35 and 36 make contact, and are deformed into a U-shape in the middle longitudinal section 3 with the depression 11. A blank 8 thus deformed is shown in the illustration of FIG. 5.

Figure 5:
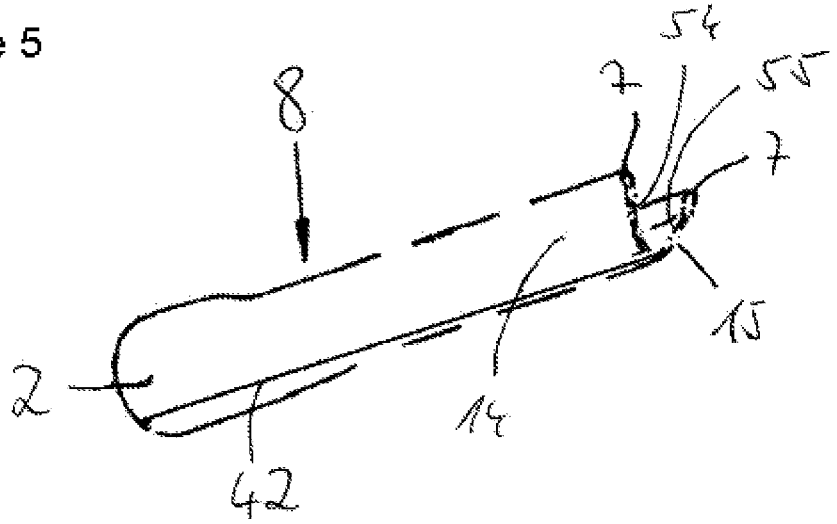
Figure 6:
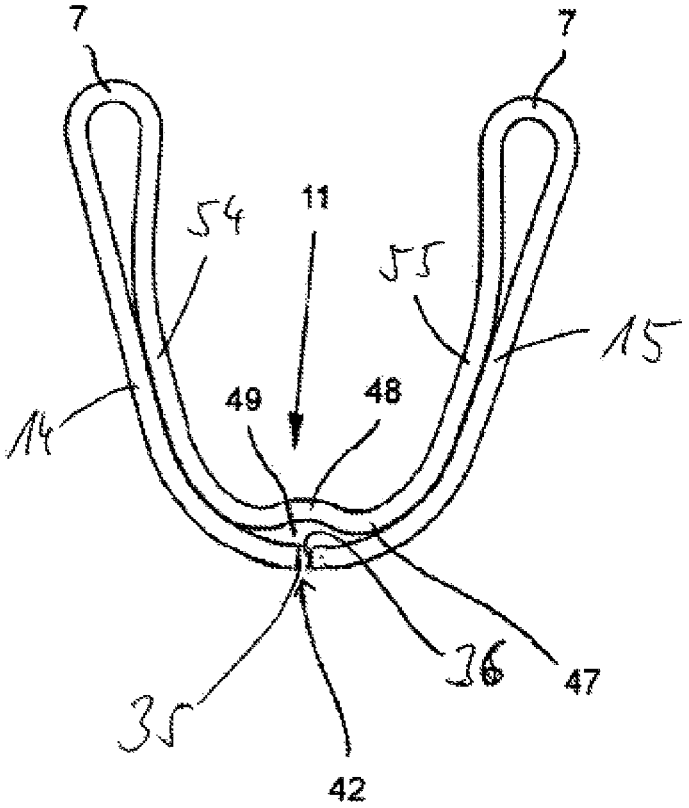
FIG. 6 shows a cross-sectional illustration of the torsional profile of FIG. 5, perpendicularly with respect to the central longitudinal plane of the depression of the torsional profile.

FIG. 6 then shows a cross-sectional illustration of the blank, deformed as per FIG. 5, in the region of the middle longitudinal section 3. Here, it can be very clearly seen that the legs 14 and 15 bear against and make contact with delimiting walls 54 and 55 of the depression 11. The longitudinal edges 35 and 36 of the legs 14 and 15 are in this case situated facing one another with the formation of a gap 42. Opposite said gap, the depression 11 is equipped, in its base 47, with a bulge 48 such that a free space 49 is formed between the legs 14 and 15 and the delimiting walls 54 and 55 in the region of the gap 42.

Figure 7:
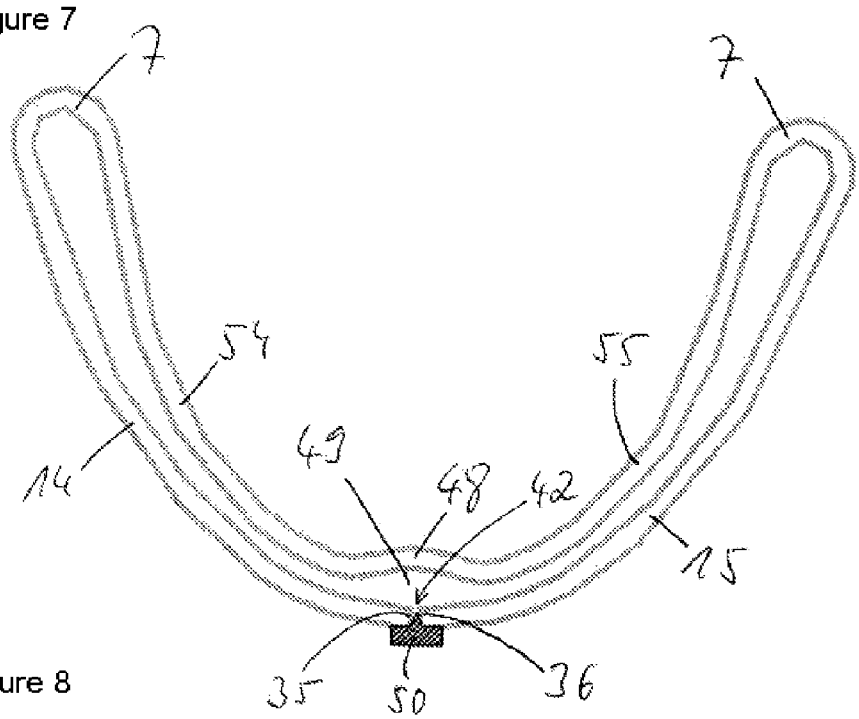
FIG. 7 shows the torsional profile as per FIG. 6 after the introduction of a spacer.
Figure 8:
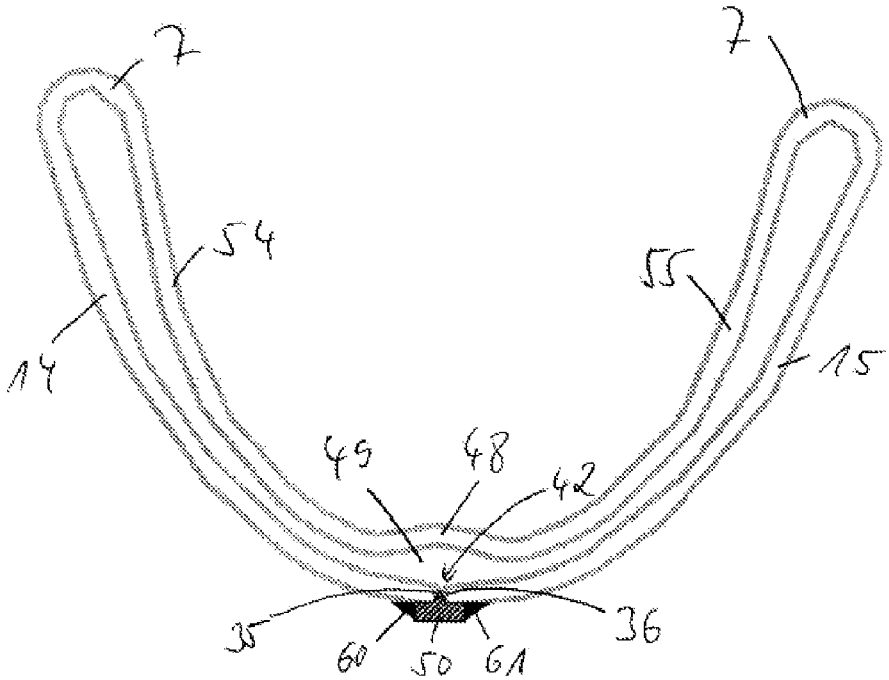
FIG. 8 shows the torsional profile as per FIG. 7 after the joining of the spacer.

To prevent contact of the legs 14 and 15 with the delimiting walls 54 and 55, a spacer 50 is introduced into the gap 42. In this case, the legs 14 and 15 are pushed apart again slightly, such that they are then no longer in contact with the delimiting walls 54 and 55 of the depression 11. The configuration of a blank 8 thus deformed is illustrated in FIG. 7, wherein it can be clearly seen that a gap is formed between the leg 14 and the delimiting wall 54 and between the leg 15 and the delimiting wall 55. To then fix the thus deformed blank 8, the spacer 50 is cohesively connected to the legs 14 and 15 with the formation of joints 61 and 62, which in the case of welding are in the form of weld seams. After the joining process, the torsional profile 1 according to the invention is then complete. In this case, said torsional profile 1 has, in its middle longitudinal section 3, which can be subjected to torsional load, no points of contact between the legs 14 and 15 and the corresponding delimiting walls 54 and 55, such that, under torsional load of the torsional profile, generation of noise owing to legs 14 and 15 and delimiting surfaces 54 and 55 rubbing against one another is prevented.

Figure 9:
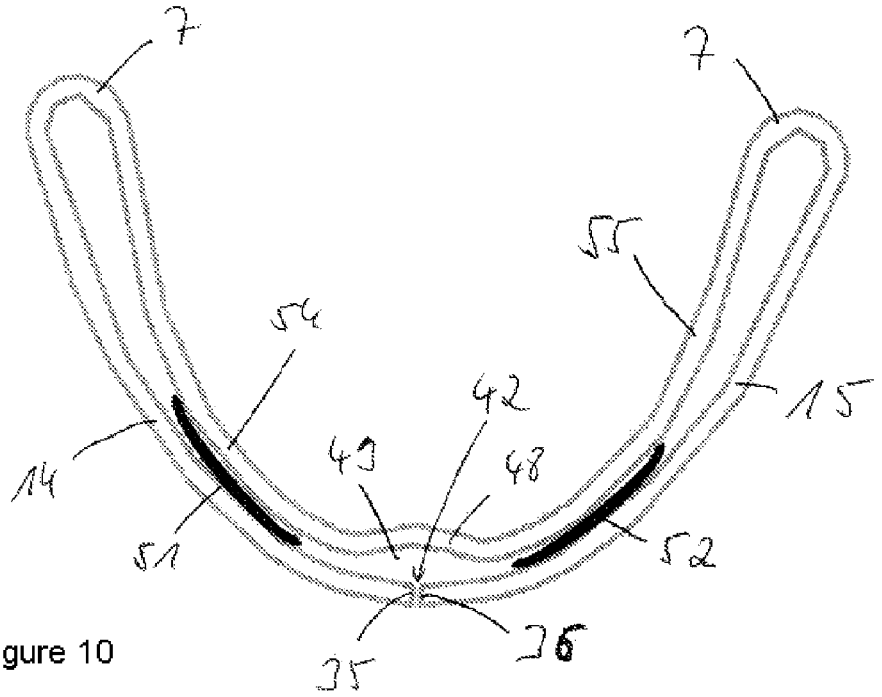
FIG. 9 shows a further exemplary embodiment of a torsional profile according to the invention, before the final joining process.
Figure 10:
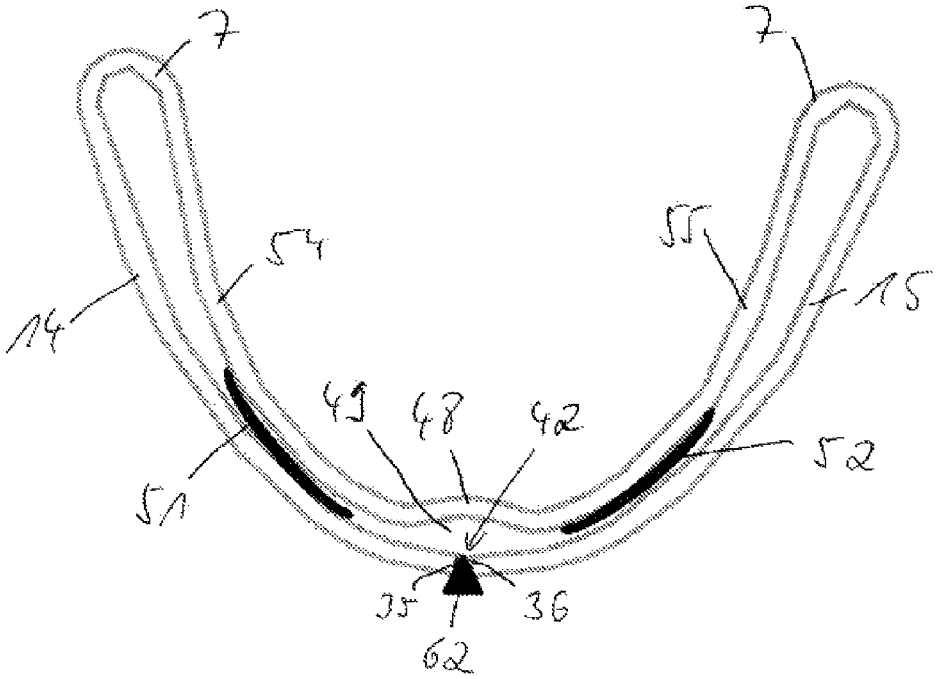
FIG. 10 shows the torsional profile as per FIG. 9 after the final joining process.

A further exemplary embodiment of a torsional profile 1 according to the invention is illustrated in FIGS. 9 and 10. As can be clearly seen here, in this exemplary embodiment, no spacer is inserted in the gap 42 between the longitudinal edges 35 and 36 of the legs 14 and 15. Rather, in this case, in each case one separate spacer 51 and 52 is inserted between the leg 14 and the delimiting wall 54 and between the leg 15 and the delimiting wall 55.

The spacer 51 spaces the leg 14 apart from the delimiting wall 54, whereas the spacer 52 spaces the leg 15 apart from the delimiting wall 55. Here, in order that no generation of noise occurs under torsional load of the torsional profile 1, it has proven to be advantageous for said spacers 51 and 52 to be formed from a solid lubricant, for example graphite, graphene, molybdenum sulfide or polytetrafluoroethylene. These materials exhibit particularly good sliding characteristics, such that no generation of noise, or no generation of noise that is perceptible to human hearing, occurs under torsional load, when said spacers 51 and 52 are moved against the legs 14 and 15 or the delimiting walls 54 and 55.

In order that a closed profile is formed in this exemplary embodiment too, the longitudinal edges 35 and 36 of the legs 14 and 15 of the blank 8 thus deformed are joined, in particular welded, to one another. Such a joint 62 is shown in FIG. 10 and, in the case of a metallic blank, is preferably in the form of a weld seam.

The spacers 51 and 52 may be correspondingly placed during different method steps during the production of the torsional profile 1 according to the invention. Firstly, the rectangular blank 8 may already be equipped with corresponding spacers 51 and 52. It is however also possible for said spacers to be correspondingly placed during other production steps during the method according to the invention.

LIST OF REFERENCE NUMERALS

1 Torsional profile
2 End section
3 Middle longitudinal section
4 Transition section
7 Longitudinal edge
8 Blank
9 Face end
10 Region
11 Depression
14 Leg
15 Leg
35 Longitudinal edge
36 Longitudinal edge
42 Gap
47 Base
48 Bulge
49 Free space
50 Spacer
51 Spacer
52 Spacer
54 Delimiting wall
55 Delimiting wall
60 Joint
61 Joint
62 Joint

What is claimed is:

1. A method for producing a torsional profile from a blank, which torsional profile has torsionally rigid tubular end sections, a torsionally flexible U-shaped middle longitudinal section and, between the middle longitudinal section and the end sections, transition sections which change from the U-shaped cross section to the tubular cross section, comprising:

a) forming a longitudinally oriented U-shaped depression into the blank at a distance from the face ends thereof, so as to form legs which extend away from the depression;

b) bending the legs of the deformed blank adjacent to the depression such that said legs are arranged substantially parallel to one another and to the middle longitudinal plane of the depression;

c) deforming the bent legs into a tubular shape in the regions adjacent to the face ends of the blank, and deforming the bent legs into a U-shape in the longitudinal section with the depression, in a manner adapted to the contour of the depression, longitudinal edges of the bent legs being arranged facing one another over their entire longitudinal extent; and d) introducing at least one spacer into the deformed blank such that the bent legs and delimiting walls, which extend in the direction of longitudinal edges of the middle longitudinal section, of the depression are held spaced apart in the middle longitudinal section, wherein the at least one spacer is arranged between the longitudinal edges of the bent legs.

2. The method as claimed in claim 1, wherein a protruding bulge is formed out of the base of the depression in the direction of the longitudinal edges of the middle longitudinal section.

3. The method as claimed in claim 1, further comprising:

joining the longitudinal edges of the deformed legs to the at least one spacer.

4. The method as claimed in claim 3, wherein the joining is performed by way of a welding process.

5. A torsional profile produced from a blank comprising:

torsionally rigid, tubular end sections;

a torsionally flexible, U-shaped middle longitudinal section which forms a depression; and between the middle longitudinal section and the end sections, transition sections which change from the U-shaped cross section to the tubular cross section, the middle longitudinal section being formed such that bent legs and delimiting walls, which extend in the direction of the longitudinal edges of the middle longitudinal section, of the depression are arranged adjacent to one another, wherein at least one spacer is provided, by means of which the bent legs and the delimiting walls of the depression are held spaced apart in the middle longitudinal section, and wherein at least one spacer is arranged between longitudinal edges of the bent legs.

6. The torsional profile as claimed in claim 5, wherein the at least one spacer is joined to the longitudinal edges of the bent legs.

7. The torsional profile as claimed in claim 6, wherein the at least one spacer is welded to the longitudinal edges of the bent legs.

8. The torsional profile as claimed in claim 5, wherein the spacing between the bent legs and the delimiting walls of the depression is uniform over the middle longitudinal section.

9. The torsional profile as claimed in claim 5, wherein, in the region of the joints, the depression has a protruding bulge which extends out of the base so as to form a free space in the direction of the longitudinal edges of the middle longitudinal section.

10. The torsional profile as claimed in claim 5, produced in accordance with a method that comprises:

a) forming a longitudinally oriented U-shaped depression into the blank at a distance from the face ends thereof, so as to form legs which extend away from the depression;

b) bending the legs of the blank adjacent to the depression such that said legs are arranged substantially parallel to one another and to the middle longitudinal plane of the depression;

c) deforming the bent legs into a tubular shape in the regions adjacent to the face ends of the blank, and deforming the bent legs into a U-shape in the longitudinal section with the depression, in a manner adapted to the contour of the depression, longitudinal edges of the bent legs being arranged facing one another over their entire longitudinal extent;

d) introducing at least one spacer into the blank such that the bent legs and delimiting walls, which extend in the direction of longitudinal edges of the middle longitudinal section, of the depression are held spaced apart at least in regions; and e) joining the longitudinal edges of the bent legs to the at least one spacer.

* * * * *